US005579568A

United States Patent [19]

Hudson et al.

[11] Patent Number: 5,579,568

[45] Date of Patent: Dec. 3, 1996

[54] METHOD FOR MOUNTING MECHANICAL ELEMENTS TO A PLATE

[75] Inventors: Hugh F. Hudson, Wauwatosa; Jeffrey R. Baldwin, Waukesha; Salvatore A. Mussomeli, Brown Deer, all of Wis.

[73] Assignee: Johnson Service Company, Milwaukee, Wis.

[21] Appl. No.: 389,274

[22] Filed: Feb. 8, 1995

[51] Int. Cl.[6] ..... B21D 39/00

[52] U.S. Cl. ..... 29/509; 29/512; 29/515; 29/520; 403/282

[58] Field of Search ..... 29/512, 520, 509, 29/515; 403/274, 276, 279, 282

[56] References Cited

U.S. PATENT DOCUMENTS

| | | | |
|---|---|---|---|
| 2,177,191 | 10/1939 | Sandberg | 29/520 |
| 2,177,377 | 10/1939 | Polivka | 29/520 |
| 2,454,326 | 11/1948 | Makenny | 29/512 |

OTHER PUBLICATIONS

Wagner Fineblanking–Fineblanking Principles Design Advantages–WF–484–1.

*Primary Examiner*—David P. Bryant
*Attorney, Agent, or Firm*—Harness, Dickey, & Pierce, P.L.C.

[57] ABSTRACT

A method for installing and securing mechanical elements, such as standoffs and pins, in a plate includes the steps of forming suitable apertures for the elements as desired locations in the plate. First ends of each standoff and pin are inserted into their respective apertures with a portion of each standoff and pin extending through the plate. Pressure is applied to the plate, the standoff and the pin to simultaneously secure the elements to the plate. In a preferred embodiment, the end of each standoff extending through the plate is stamped or rolled over to form a retaining flange. The pins are preferably clenched to the plate by pressing an inverted V-shaped ring into the surface of the plate surrounding each pin. An apparatus for installing standoffs and pins in a plate is also provided.

6 Claims, 3 Drawing Sheets

METHOD FOR MOUNTING MECHANICAL ELEMENTS TO A PLATE

BACKGROUND OF THE INVENTION

1. Field of the Invention

The present invention relates generally to an improved method and apparatus for mounting elements such as gear pins and standoffs to a plate. More particularly, the invention relates to a method and apparatus that permits a plurality of such elements to be installed in a single operation at desired locations on a plate.

2. Description of Related Art

A number of assembled mechanical and electro-mechanical devices, such as actuators, meters, measurement devices and the like, are constructed of two or more plate-like elements arranged generally parallel to one another and held in spaced relation by standoffs. Movable elements such as gears, levers and the like are typically mounted on pins between the plates and interlinked to cooperatively carry out the function of the device. While the standoffs themselves may serve to support certain of the functional elements, this task is more often reserved for the pins, the standoffs serving only to maintain spacing between the plates and to unify the assembly. Moreover, because such functional elements typically subject the mounting pins to considerable axial and radial loading during operation, the pins must be solidly supported on one of the plates to maximize the accuracy and useful life of the device. Similarly, the standoffs must resist loading transmitted to the plates and ensure the structural integrity of the assembly.

Devices of the type described above are generally assembled by first securing standoffs and pins to one of the mounting plates. The functional elements are then assembled on the pins and the second plate is secured to the free ends of the standoffs to complete the assembly. Particularly important in this assembly process are the steps of forming holes in the mounting plate and inserting and securing the standoffs and pins in the corresponding holes. Punching or stamping machines are typically used to form the holes for the standoffs and pins. The mounting plate itself may be stamped from a sheet of stock in the same stamping operation used to form the holes. Once holes of suitable size are pierced at desired locations, standoffs and pins are mounted to the plate in separate operations. The standoffs are generally secured to the plate by peening or rolling an end of the standoffs protruding through the plate. The pins, which may be knurled or splined, at least in the region to be inserted in the plate, are typically pressed or otherwise force fitted into suitably dimensioned holes. Throughout these operations, the quality of each joint and the angular alignment of all standoffs and pins must be monitored to ensure that the final assembly will meet acceptable manufacturing tolerances.

While such conventional assembly techniques have been used for many years in the fabrication of a wide variety of mechanical and electro-mechanical devices, they are not without drawbacks. Specifically, a disadvantage of such techniques is the relatively large number of process steps required to align, insert and secure the standoffs and pins. Moreover, as the number of such process steps increases, so do the material handling and assembly times, as well as quality control costs. In addition, such techniques do not always provide secure and reliable mounting, ultimately resulting in reduced life and high maintenance costs for the finished product.

The present invention advantageously provides an improved method and apparatus for mounting standoffs and pins to a plate, wherein a plurality of standoffs and pins can be inserted and secured to the plate in a single operation. The method and apparatus also inherently provide control of the angular alignment of the standoffs and pins with respect to the plate.

SUMMARY OF THE INVENTION

The invention features a novel method that greatly facilitates mounting and securing standoffs and pins to a plate. The method not only reduces the number of steps and the time required for mounting the standoffs and pins, but simplifies and improves quality control, particularly of the angular alignment and retaining force of such elements. Thus, in accordance with a first aspect of the invention, an innovative method for mounting a cylindrical pin in a plate is provided that affords improved retention and angular alignment of the pin. Plates used in the method generally include first and second sides and are of a substantially uniform thickness. The method includes the steps of forming a hole in the plate and inserting the pin into the hole substantially perpendicularly with respect to the plate, whereby a portion of the pin protrudes from the first side of the plate. An annular groove is then stamped in the first side of the plate surrounding the pin to secure the pin to the plate.

The invention also features a novel method for mounting a pin and a standoff in a plate having first and second sides. In accordance with this aspect of the invention, holes are formed in the plate at desired locations for the pin and standoff. A first end of the standoff and a first end of the pin are inserted into their respective holes, whereby a portion of the standoff and a portion of the pin extend substantially perpendicularly from the first side of the plate. Pressure is then applied to the plate, the standoff and the pin to simultaneously secure the standoff and the pin to the plate.

In accordance with another feature of the invention, an apparatus is provided for securing a standoff and a pin in holes at desired locations in a plate. The apparatus includes a die block having locating cavities configured to receive the standoff and the pin respectively. The locating cavities support the standoff and the pin in a desired orientation with respect to the plate. The apparatus further includes a platen spaced from the die block and movable with respect to the die block. An actuator is coupled to the platen for moving the platen with respect to the die block to apply pressure to the plate, the standoff and the pin to secure the standoff and the pin at their respective locations in the plate.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Before beginning the detailed description of the FIGURES and the preferred embodiments shown therein, several general comments will assist in understanding the scope of the invention.

The most preferred and illustrated embodiments of the present invention are particularly suited for assembling cylindrical metal standoffs and pins in a at desired locations on a metal plate, in a perpendicular orientation with respect to the plate. In the most preferred embodiment described below, the standoffs are configured with a shoulder designed to rest and bear on a surface of the plate and an end portion of reduced diameter that is secured to the plate by stamping the end to upset or roll over material extending through the plate. The pin is preferably a smooth, cylindrical metal pin dimensioned to slip into a preformed aperture in the plate and secured to the plate by upsetting material surrounding the pin. Numerous applications exist for such assemblies, including in mechanical and electro-mechanical actuators, control cabinets and the like.

However, the invention is not intended to be limited to the particular materials discussed below or to any particular configuration of the standoffs or pins. For example, the method discussed below may be equally applicable for securing plastic or composite elements on a plate. Moreover, while the following discussion refers to securing such elements to a plate, it should be understood that the method and apparatus described may generally be used to fasten elements to mechanical members having shapes or contours not strictly limited to a single plane, such as in mechanical housings, frames and the like. Finally, particularly as regards the method and apparatus for simultaneously installing standoffs and pins discussed below, various standoff and pin configurations can be envisaged, including elements having smooth, splined or knurled end regions configured to be held in the plate by an interference fit.

Figure 1:
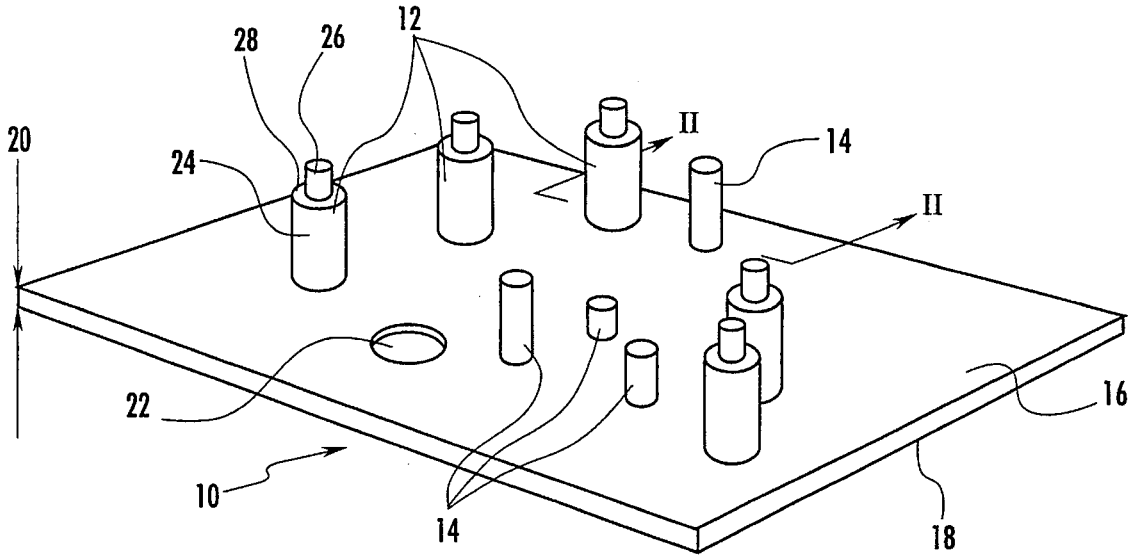
FIG. 1 is a perspective view of a plate on which a number of standoffs and pins have been mounted.

Turning now to the particularly preferred embodiments and referring first to FIG. 1, the invention provides a method and apparatus for securing elements in a plate 10. In particular, standoffs 12 and pins 14 are rigidly mounted to plate 10 and extend from a first or top surface 16 thereof. As illustrated in the FIGURES, plate 10 also has a second or bottom surface 18 and generally constant thickness 20. In addition to standoffs 12 and pins 14, plate 10 may include additional features such as cut-out areas or apertures 22 through which input shafts, output shafts or other elements (not shown) may extend in the final assembly in which plate 10 is incorporated. As will be appreciated to those skilled in the art, plate 10, standoffs 12 and pins 14 will generally constitute a relatively low level subassembly on which additional functional elements, such as gears, levers, dials and the like, will be mounted as fabrication of a final assembly progresses. In a typical example, gears of varying diameter and thickness will may be mounted on pins 14 and a second plate (not shown) mounted on standoffs 12 to form a sandwich or layered assembly with the functional elements contained between plate 10 and the second plate.

In the embodiment illustrated in FIG. 1, standoffs 12 have a generally cylindrical mid-section 24 and include, at each end, a cylindrical extension 26 of reduced diameter and a stepped shoulder 28 intermediate the mid-section 24 and extension 26. Standoffs 12 of this type are typically available in various standard lengths and diameters, such that appropriately dimensioned standoffs may be selected depending upon the particular structural and dimensional specifications of the final assembly. Once mounted in the final assembly, standoffs 12 typically function as both compression and tension members, lending structural rigidity to the assembly.

Figure 2:
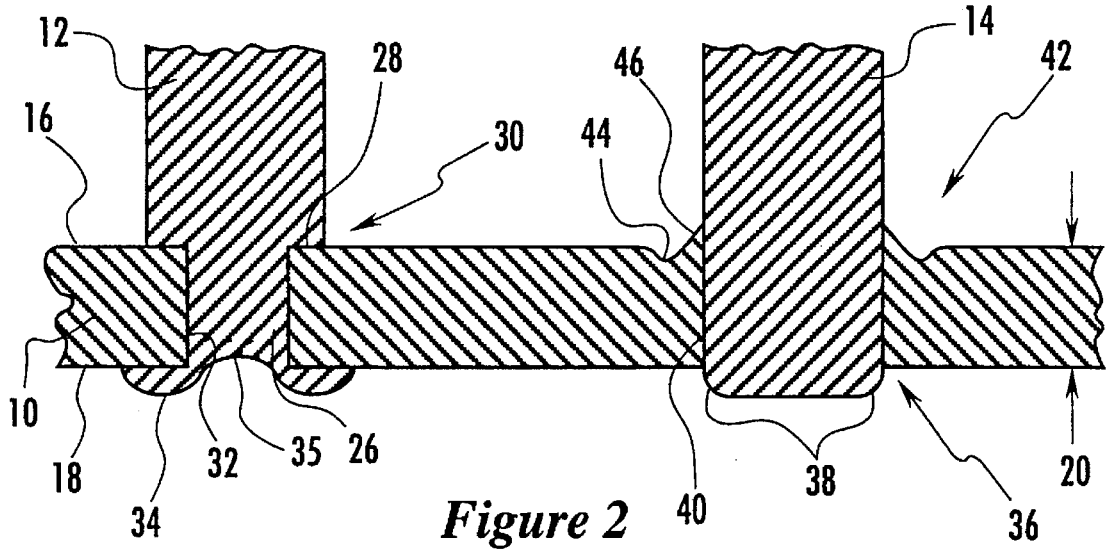
FIG. 2 is a sectional view through a portion of the plate, a standoff and a pin as illustrated in FIG. 1 along section 2—2.

Extension 26 and shoulder 28 comprise an end section 30 designed to contact and cooperate with appropriate apertures 32 formed in plate 10 as follows. As best illustrated in FIG. 2, extension 26 is configured to extend through plate 10 from first side 16 to second side 18 such that, when fully inserted into aperture 32, shoulder 28 bears against and is supported on first surface 16. Aperture 32 is typically dimensioned to provide a close slip fit around extension 26. Standoff 12 may be secured to plate 10 by various known techniques, such as by stamping, peening, punching or rolling the portion of end section 30 extending beyond second side 18 to form an annular flange or lip 34 of material surrounding a central recess or cavity 35. Such techniques generally rely upon upsetting or compressing material in end section 30 a sufficient degree to cause contact between extension 26 and aperture 32 and, in the embodiment illustrated, to lay a portion of extension 26 over surface 18 to form flange 34.

In the preferred embodiment illustrated in the FIGURES, pin 14 is a cylindrical metallic pin having smooth sides terminating in ends 36 with rounded or radiused comers 38. Each pin 14 is received in an appropriate aperture 40 in plate 10, aperture 40 being dimensioned to provide a close slip fit (e.g. typically of the order of 0.0008 inch clearance) with pin 14. The rounded corners 38 of pin 14 facilitate centering and inserting pin 14 into aperture 40. In the preferred embodiment illustrated, pin 14 is securely retained in plate 10 by an upset region 42 formed on in first side 16 after insertion of pin 14. Upset region 42 is formed in a manner described in detail below and generally includes an annular trough or groove 44 surrounding a built-up retaining ridge 46 in contact with pin 14.

While the particular configuration of pin 14 and upset retaining region 42 discussed herein are generally preferred and are suitable for most applications, pin 14 may, of course, be adapted to particular applications and alternative retention schemes. For example, pin 14 may be provided with a shoulder region designed to bear against plate 10. Similarly, an enlarged end may be provided on pin 14 with a shoulder region generally facing in the same direction as surface 16 for receiving and supporting a functional element such as a gear. Finally, end 36 of pin 14 may be provided with a knurled or splined surface designed to establish an interference fit with aperture 40 as pin 14 is inserted into plate 10 as described below.

The preferred apparatus and method for locating, inserting and securing standoffs 12 and pins 14 in plate 10 will now be described with particular reference to FIG. 3. A die block 48 includes a number of cavities 50 and 62 corresponding to the number of standoffs 12 and pins 14, respectively, to be inserted into plate 10. Cavities 50 and 62 are appropriately located and dimensioned to receive and support standoffs 12 and pins 14 in the orientation they will have in plate 10 once secured in place. While cavities 50 and 62 formed in block 48 may be machined to conform to the contours of standoffs 12 and pins 14, they are preferably cylindrical cavities configured to receive and support die buttons 52 and 64, which themselves include contoured support cavities 54 and 66 respectively, designed to conform to standoffs 12 and pins 14. Each standoff support cavity 54 is dimensioned to releasably receive a standoff 12 in a close slip fit and to support standoff 12 during insertion and fixation in plate 10. Accordingly, cavity 54 will typically include shoulder support surfaces 56 and an end support surface 58 for resisting forces encountered as standoff 12 is inserted and secured in place. Similarly, each pin support cavity 66 is dimensioned to releasably receive a pin 14 in a close slip fit and to support pin 14 during insertion and fixation to plate 10, such as by an end support surface 68.

The use of standoff and pin die buttons 52 and 64 offers several advantages. Firstly, such buttons enhance the flexibility of the apparatus by allowing a single die block 48 to be pre-formed for several different plate layouts. Moreover, wear due to repeated cycling in an automated manufacturing installation will tend to be concentrated in die buttons 52 and 64 rather than in die block 48 itself. When such wear becomes excessive, die buttons 52 and 64 alone can be replaced without necessitating retooling of die block 48. Finally, buttons 52 and 64 having differently shaped cavities for accommodating standoffs 12 and pins 14 of different sizes, shapes and lengths may be made and installed in die block 48 as required from time to time, such as by product design changes and the like.

It should also be noted that die block 48 and die buttons 52 and 64, along with support cavities 50 and 62, are designed and machined to present a generally planar upper surface 60. In addition, support cavities 54 and 66 are designed to support standoffs 12 and pins 14 at a desired height with respect to upper surface 60. Thus, support shoulder 28 of each standoff 12 will typically be held flush with upper surface 60, such that extension 26 protrudes above surface 60 sufficiently to enter and extend through aperture 32 in plate 10 during installation. In the same way, each pin 14 projects above surface 60 a sufficient amount to insert pin 14 through plate 10.

In addition to support cavity 66, each pin die button 64 includes an annular protrusion 70 surrounding cavity 66 and extending above upper surface 60. Protrusion 70 has a generally inverted V-shape, designed to engage surface 16 of plate 10 and to exert localized compression around pin 14, thereby upsetting the material of plate 10 and forming annular groove 44 and retaining ridge 46.

It has been found that retention of standoffs 12 and pins 14 may be improved by controlling the geometry of the portions of plate 10 bordering apertures 32 and 40. In particular, the retention of pins 14 secured by clenching or upsetting material to form annular groove 44 and built-up retaining portion 46 is enhanced considerably by forming apertures with substantially vertical side walls and having a relatively high proportion of controlled tolerance surface. The presently preferred method for piercing apertures is a fineblanking process. Such processes are generally known in the art and typically provide as much as 80 % controlled tolerance surface.

Figure 3:
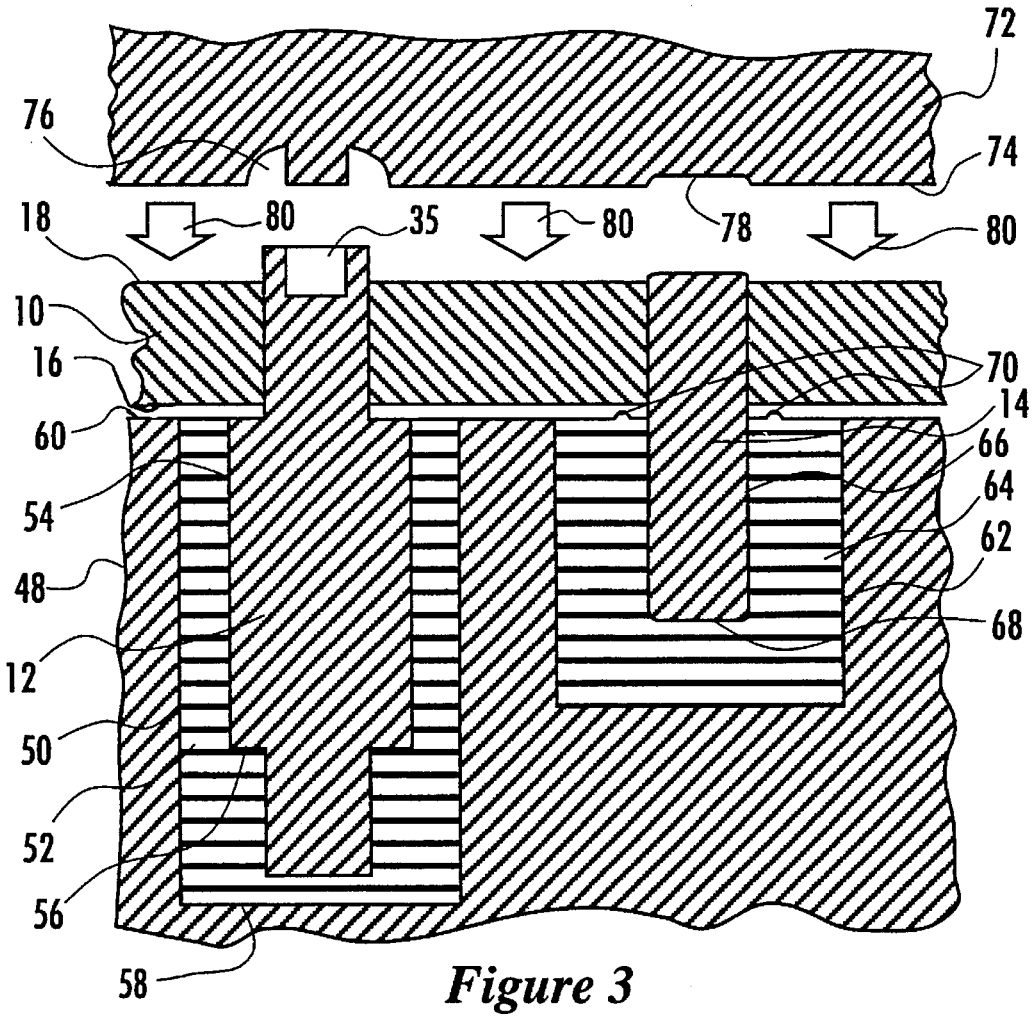
FIG. 3 is a sectional view of a preferred arrangement for mounting and securing the standoff and pin shown in FIG. 2, in which the standoff and pin are inserted and secured in the plate by pressure applied by a die block and platen.

The preferred apparatus illustrated in FIG. 3 further includes a platen or pressure plate 72 positioned above die block 48 for exerting pressure at a level sufficient to secure standoffs 12 and pins 14 at their desired locations within plate 10. Several features, generally in the form of specially contoured recesses, are provided in the lower surface 74 of platen 72. For each standoff 12, an annular cavity 76 is provided for contacting extension 26 of the standoff and rolling it over to create retaining flange 34. For each pin 14, a shallow relief or recess 78 permits the pin to protrude slightly from second surface 18 of plate 10 as the plate is pressed into contact with annular ring 70.

Standoffs 12 and pins 14 are secured to plate 10 as follows. Die block 48, buttons 52, 64 and platen 72 are pre-formed as described above, with cavities 54, 66 and features 76, 78 at locations corresponding to the desired positions of standoffs 12 and pins 14. Die block 48 and platen 72 are then assembled in a work station, wherein platen 72 is typically supported on a press, such as a hydraulic press (not shown), equipped with a suitable control system for causing hydraulic pressure to lower platen 72 toward die block 48. It has been found such low-impact compression arrangements better promote flow of the material of plate 10 surrounding pins 14 during the compression clenching operation.

Standoffs 12 and pins 14 may be fed to the work station by a suitable conveyance system and are dropped into buttons 52, 64. Plate 10, having apertures 32 and 40 formed therein for each standoff 12 and pin 14, is then brought between die block 48 and platen 72 and positioned such that apertures 32 and 40 overlie the corresponding standoffs 12 and pins 14. Platen 72 is then lowered to contact standoffs 12 and plate 10 as illustrated by arrows 80 in FIG. 3, pressing plate 10 downwardly onto die block 48. Sufficient force is applied to platen 72 to roll retaining flange 34 on each standoff and to cause the annular ring 70 surrounding each pin to penetrate into surface 16 of plate 10, thereby clenching the pins in their respective apertures. Platen 72 is then raised and plate 10 is removed from die block 48 with standoffs 12 and pins 14 secured thereon.

Figure 4:
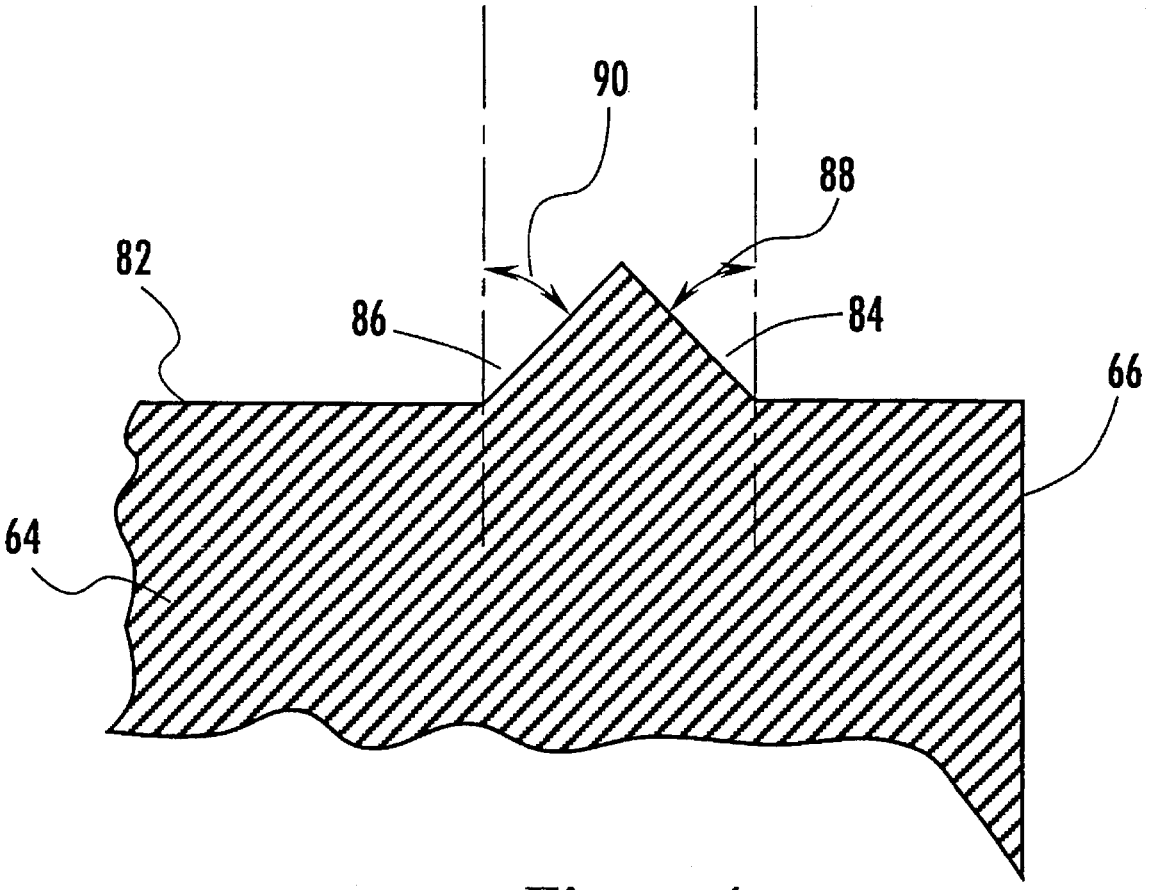
FIG. 4 is a detail view of a section of the die block shown in FIG. 3, illustrating a preferred configuration for stamping the plate surrounding the pin to secure the pin to the plate.

An exemplary cross-sectional configuration for annular ring 70 is illustrated in FIG. 4. Annular ring 70 forms a continuous ridge surrounding pin locating and support cavity 66. While the specific configuration and placement of ring 70 may be adapted to a particular application, ring 70 is preferably located as close to cavity 66 as feasible without actually contacting or interfering with pins placed in the cavity, thereby allowing such pins to be slipped into and out of cavity 66. Ring 70 rises above the upper surface 82 of die button 64 in an inverted V-shaped cross section including an inner inclined surface 84 and an outer inclined surface 86. Inner and outer inclined surfaces 84 and 86 define slopes or angles 88 and 90 respectively with respect to the vertical. While various angles 88 and 90 may be provided on ring 70, it has been found that an inner angle 88 of approximately 65 degrees and an outer angle of approximately 35 degrees provide good flow of the material of plate 10 surrounding pins 14 and satisfactory retention of the pins in their respective apertures.

Several methods may be envisaged for limiting the penetration of annular ring into plate 10 during clenching of pins 14 in their respective apertures. For example, the height of annular ring 70 may be adapted for particular applications, whereby platen 72 may be lowered fully onto die block 48 to force substantially the entire ring 70 into surface 16 of plate 10. Alternatively, annular rings 70 of a standard height and shape may be used on all pin die buttons 64 and one or more spacers (not shown) placed between die block 48 and platen 72 to limit penetration of the annular rings 70 as required by a particular application. However, in the presently preferred method, the degree of penetration of rings 70 into plate 10 is regulated by controlling the force with which platen 72 is brought down against die block 48. Moreover, as will be appreciated by those skilled in the art, the compressive force exerted by platen 72 will vary with each specific application and is dependent upon such factors as the number and size of standoffs and pins to be secured to the plate, the thickness and hardness of the plate, and the geometry and location of annular ring 70.

We claim:

1. A method for mounting a pin having a substantially cylindrical body portion and a standoff having a substantially cylindrical body portion and a first shoulder portion formed at a first end and second shoulder portion formed at a second end to a plate having a first and second surface, the method comprising the steps of:

(a) forming holes in the plate at respective locations for the pin and standoff, (b) receiving the pin and standoff in respective cavities of a die block, (c) positioning the plate adjacent the die block with the pin and standoff received in the respective holes and the first shoulder portion abutting the first surface;

(d) simultaneously applying pressure to the standoff and to the plate to upset the first end of the standoff against the second surface and to upset the plate adjacent the pin.

2. The method of claim 1 wherein the plate is upset to form an annular groove about the pin.

3. The method of claim 1 wherein the second shoulder portion abuts a complimentary shoulder portion formed in the respective die block cavity.

4. The method of claim 1 wherein the step of simultaneously applying pressure comprises moving a platen relative to the die block, the platen having a pressure surface, the pressure surface having an annular recess formed therein for engaging the first end of the standoff and a relief portion for avoiding engagement of the pressure surface with the pin.

5. The method of claim 1 wherein the holes are formed by fine line blanking.

6. The method of claim 1 wherein the pin includes a knurled section and wherein the step of positioning the plate adjacent the die block comprises inserting and pressing a portion of the knurled section through the respective hole in the plate.

* * * * *